US006968785B2

(12) United States Patent
Auman et al.

(10) Patent No.: US 6,968,785 B2
(45) Date of Patent: Nov. 29, 2005

(54) LOCKING AND STABILIZING DEVICE FOR GRENADES

(75) Inventors: Lamar M. Auman, Union Grove, AL (US); Douglas J. Love, Huntsville, AL (US); Brad L. Bachelor, Athens, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 242 days.

(21) Appl. No.: 10/666,824

(22) Filed: Sep. 22, 2003

(65) Prior Publication Data

US 2005/0188876 A1 Sep. 1, 2005

(51) Int. Cl.[7] ..... F42C 15/23; F42C 15/184; F42B 10/56

(52) U.S. Cl. ..... 102/386; 102/387; 102/396; 102/482; 102/487; 102/254

(58) Field of Search ..... 102/384, 385, 102/386, 387, 388, 393, 396, 482, 487, 488, 102/489, 221, 222, 254, 258; 244/3.24, 3.27, 244/3.28, 3.29, 3.3

(56) References Cited

U.S. PATENT DOCUMENTS

| | | | | | |
|---|---|---|---|---|---|
| 3,788,230 | A | * | 1/1974 | Losfeld | 102/260 |
| 3,877,379 | A | * | 4/1975 | Losfeld | 102/222 |
| 3,926,122 | A | * | 12/1975 | Wolterman | 102/226 |
| 4,488,488 | A | * | 12/1984 | Looger et al. | 102/387 |
| H000251 | H | * | 4/1987 | Field | 102/487 |
| 4,662,278 | A | * | 5/1987 | Lillios | 102/223 |
| 4,715,282 | A | * | 12/1987 | Rosenberg et al. | 102/227 |
| 4,762,066 | A | * | 8/1988 | Rudenauer et al. | 102/226 |
| 4,773,330 | A | * | 9/1988 | Losfeld | 102/487 |
| 4,811,664 | A | * | 3/1989 | Levy et al. | 102/226 |
| 5,046,424 | A | * | 9/1991 | Skowasch et al. | 102/226 |
| 5,048,419 | A | * | 9/1991 | Skowasch | 102/226 |
| 5,153,371 | A | | 10/1992 | Grau et al. | 102/386 |
| 5,275,101 | A | * | 1/1994 | Chemiere et al. | 102/235 |
| 5,387,257 | A | * | 2/1995 | Tari et al. | 102/226 |
| 5,932,834 | A | * | 8/1999 | Lyon et al. | 102/226 |
| 6,142,079 | A | * | 11/2000 | Diorio | 102/215 |
| 6,253,681 | B1 | * | 7/2001 | Roosmann et al. | 102/386 |
| 6,405,652 | B1 | * | 6/2002 | Hoffmann et al. | 102/230 |
| 6,530,324 | B1 | * | 3/2003 | Steele et al. | 102/254 |
| 6,848,367 | B2 | * | 2/2005 | Fouqueau et al. | 102/489 |

* cited by examiner

*Primary Examiner*—Michael J. Carone
*Assistant Examiner*—James S. Bergin
(74) *Attorney, Agent, or Firm*—Hay Kyung Chang

(57) ABSTRACT

The locking and stabilizing device for grenades utilizes a solid nylon ring and multiple nylon ribbons that are attached to the ring at regular intervals around its circumference. During storage, the ring surrounds and locks the slider of the grenade in its storage position. But upon deployment, under aerodynamic forces the ring moves away from the slider, releasing the slider. When the slider is thusly released, it slides out and brings the detonator in place to be impacted upon by the pin when the grenade hits the target, thus detonating the grenade. The multiple ribbons extending from the ring unfurl due to the aerodynamic forces and provide stability to the grenade flight.

4 Claims, 2 Drawing Sheets

LOCKING AND STABILIZING DEVICE FOR GRENADES

DEDICATORY CLAUSE

The invention described herein may be manufactured, used and licensed by or for the Government for governmental purposes without the payment to us of any royalties thereon.

BACKGROUND OF THE INVENTION

Currently, grenades such as the M77 and M42 each has a single nylon ribbon whose ends are welded together ultrasonically so that the ribbon forms a loop. These grenades are normally deployed by being jettisoned out of a missile warhead and must fly toward and impact upon the selected targets. During storage and prior to deployment, the ribbon loop is staked to the grenade arming pin, folded and held in place by one or more clips and a plastic slider-lock. Upon deployment, however, the clips and slider-lock are detached and discarded by aerodynamic forces, allowing the ribbon to unfurl and provide a measure of stabilization to the flight of what is an essentially unstable flying object. Frequently, due to lack of sufficient stabilization during the flight, the grenade falls on its side rather than vertically (or close to vertically) relative to the surface of the intended target. This results in the failure of the grenade to detonate, increasing the likelihood of a later accidental detonation when its side-lying position is unintentionally or unwittingly disturbed.

SUMMARY OF THE INVENTION

The locking and stabilizing device for grenades utilizes a solid nylon ring and multiple nylon ribbons that are attached to the ring as well as to the arming pin of the grenade. During storage, the ring locks the slider of the grenade in its storage position for safing. But upon deployment, the ring moves away from the slider under aerodynamic forces, releasing the slider. When the slider is thusly released, it slides out and brings the detonator in position to be impacted upon by the pin when the grenade hits the target. The multiple ribbons extending from the ring unfurl due to the aerodynamic forces and provide stability to the grenade flight.

DESCRIPTION OF THE PREFERRED EMBODIMENT

Figure 1:
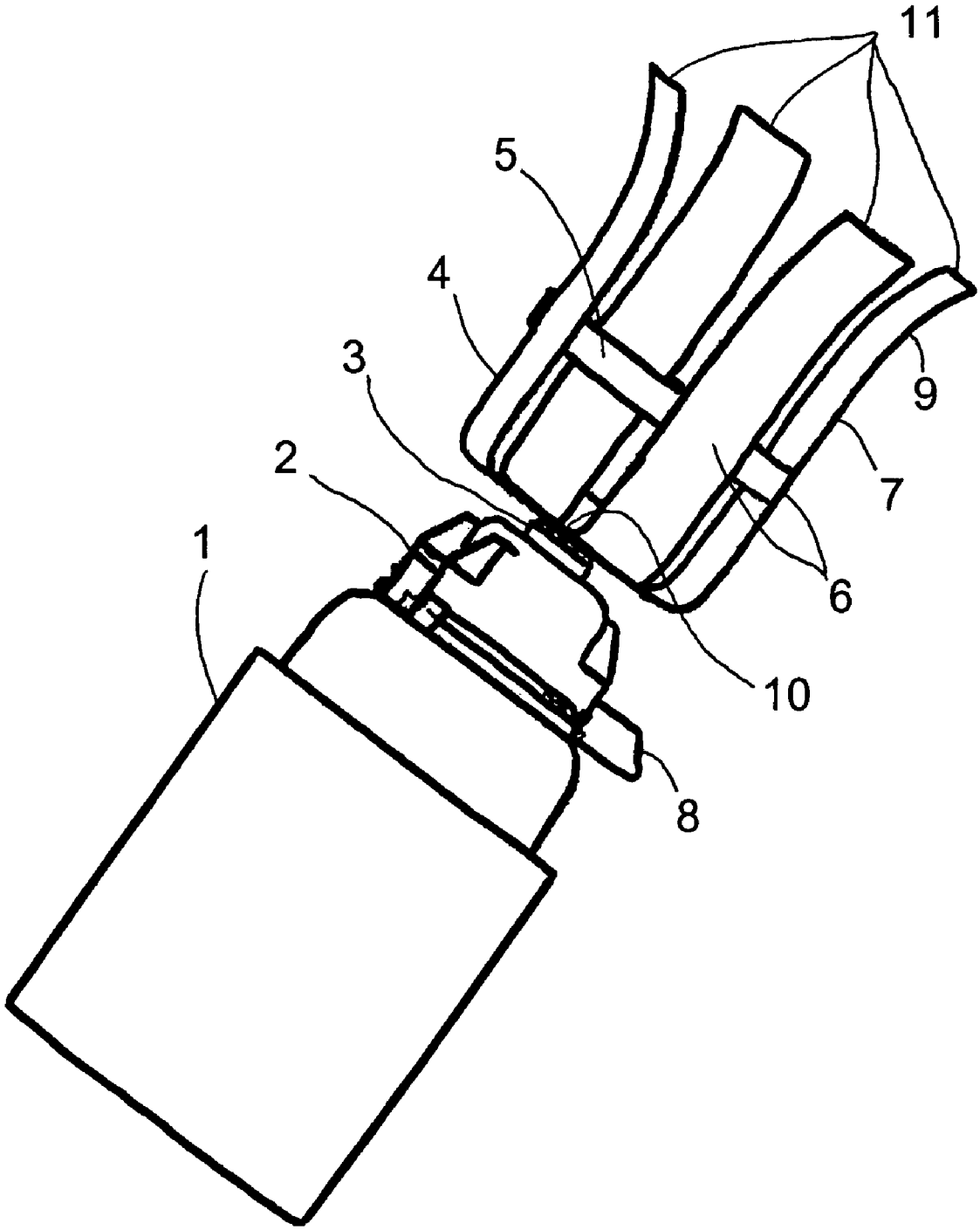
FIG. 1 shows the preferred embodiment of the locking and stabilizing device.

Referring now to the drawing wherein like numbers represent like parts in each of the figures, the structure of the locking and stabilizing device is explained in detail. A typical grenade on which this device can be used has body 1, fuze 2, firing (or "arming") pin 3 and slider 8.

During storage and handling of the grenade prior to placement in the missile or other carrier vehicle from which it will be dispatched in flight, ring 5 is positioned against the outer perimeter of the slider. Thus, the ring must have a diameter that is slightly larger than that of the slider so as to fit securely around the circumference of the slider, yet be removable from the slider by aerodynamic forces. The ring may be made of any suitable material such as solid nylon but must be thick enough to maintain its shape when deployed.

To this ring are attached a plurality of nylon ribbons 7. Even though FIG. 1 shows four ribbons, any number of ribbons may be used, depending on the desired degree of stability in the grenade flight. It is noted, however, that an even, rather than an odd, number of ribbons is better suited to achieving stability, especially if they are regularly spaced along the circumference of the ring. Further, no significant additional benefit is expected beyond ten ribbons. The ribbons are ultra-sonically welded to the ring leaving a first portion 4 of each ribbon between the ring and firing pin 3. Front ends 10 of all the ribbons are gathered together and staked to the pin. This allows the ring and the ribbons to remain connected to the grenade upon deployment. Prior to deployment, the ring nestles the slider and the ribbons are folded for compactness.

When dispatched from the carrier vehicle, aerodynamic forces unfurl the ribbons and pull the ring away from its storage position, allowing slider 8 to slide out and bring the detonator that is inside the slider into position to be impacted upon by the firing pin. The firing pin itself is unscrewed from the fuze by the combination of small oscillations of the grenade during flight and the drag of the ribbons. Now the grenade is armed.

Figure 2:
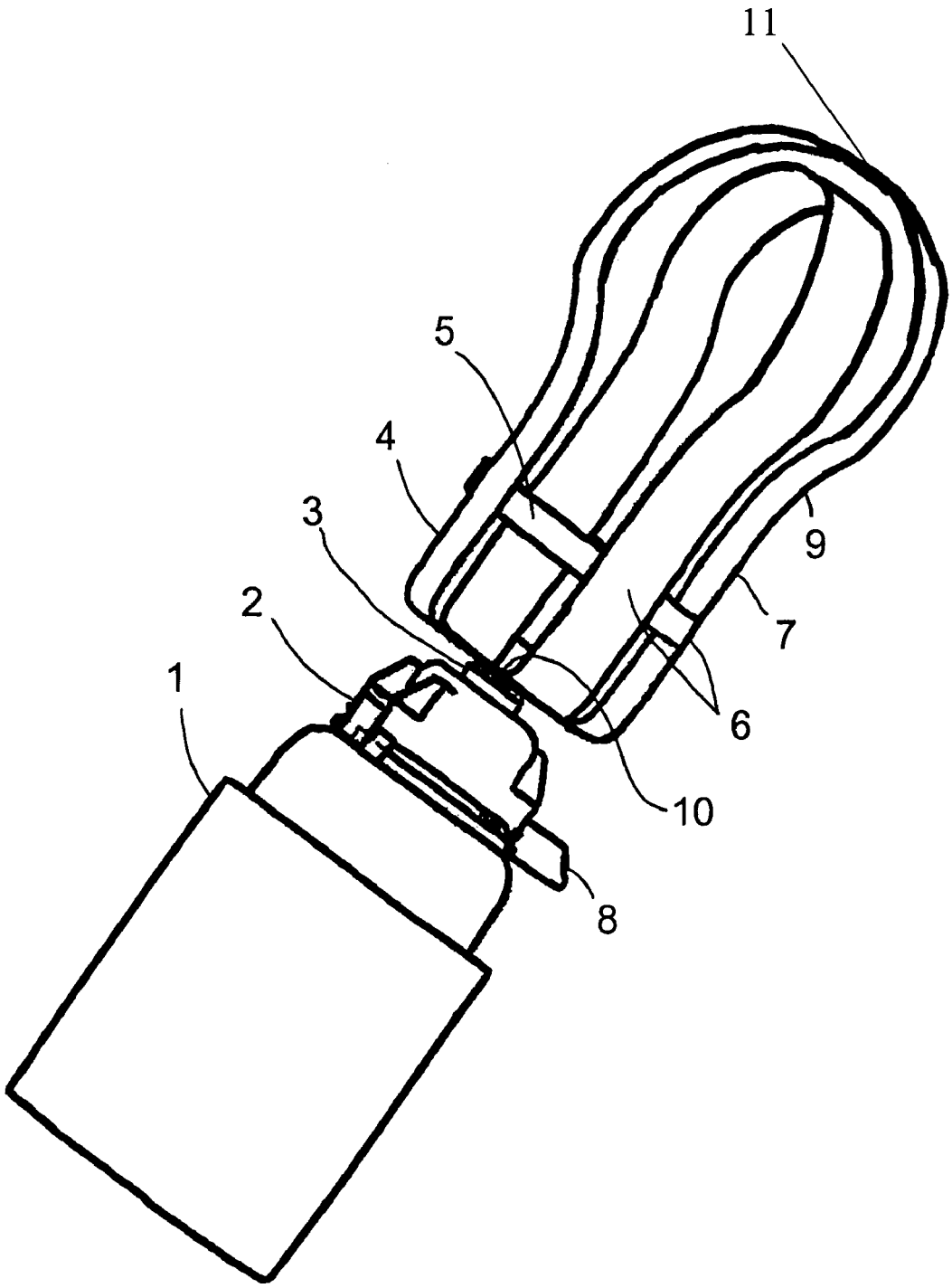
FIG. 2 illustrates the looping of the ribbons.

The stabilization provided by the unfurled ribbons directs the grenade to hit the surface of the target more perpendicularly so as to increase the likelihood of the grenade detonation. The ribbons, when unfurled, may be of varying lengths and widths, depending on the desired degree of stability and expected aerodynamic drag. Usually, the longer lengths will provide greater stability, but storage may be a consideration. Typical entire lengths for the ribbons range from 1 to 6 times the diameter of grenade body 1, while the lengths of first portion 4 may range from 0.25 to 1 times the diameter of the body. Back ends 11 at the terminus of second portion 9 of the ribbons may remain free as in FIG. 1 or attached together to form pairs of loops as shown in FIG. 2. Paired looping is preferred.

To assemble the ring and the ribbons, the ring is layed flat and the ribbons are evenly spaced and attached to the ring using an ultrasonic welder. Afterwards, the ring is looped and welded at the ends. In ultrasonic welding, the nylon material in weld zone 6, where the ring and ribbons come together, is flexed by an oscillating force delivered by a horn at rates of 10,000 to 70,000 kHz. This causes the nylon to melt and flow across the joint to form a weld. There are various ways to generate the oscillating force. One is by using a series of tuned components that are sized to form a resonant system when power is applied. The first component converts the electrical power to oscillations which are amplified by a booster that is connected to the horn. The horn can either amplify or de-amplify the oscillations, depending on the needs of the welding application.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A device for locking a grenade during storage and stabilizing the flight of the same grenade upon deployment, the grenade having a body, a fuze, a firing pin and a slider containing therein a detonator, said locking and stabilizing device comprising: a nylon ring, said ring being removably positioned to hold said slider in place and prevent any movement of said slider during storage but moving away from said slider upon deployment, thereby allowing said slider to move and arm said grenade; and a plurality of nylon ribbons, each ribbon having a front end and a back end, said ribbons being welded to said ring and being further attached at said front ends to said pin, said ribbons providing stabilization to the grenade flight so as to increase the likelihood of detonation of the grenade upon impact on a target.

2. A locking and stabilizing device as set forth in claim 1, wherein said ribbons are at least four in number and vary in length and width to provide a desired degree of stability to the grenade flight.

3. A locking and stabilizing device as set forth in claim 2, wherein each of said ribbons comprises a first portion and a second portion, said portions having said nylon ring therebetween.

4. A locking and stabilizing device as set forth in claim 3, wherein said back ends of said ribbons are welded together to form multiple pairs of loops.

* * * * *